US008225629B2

(12) United States Patent
Zuraski et al.

(10) Patent No.: US 8,225,629 B2
(45) Date of Patent: Jul. 24, 2012

(54) PORTABLE LOCK WITH ELECTRONIC LOCK ACTUATOR

(75) Inventors: Robert D. Zuraski, Taunton, MA (US); Cornelius McDaid, Randolph, MA (US); John Paul Thambusami Joy Sachidanadam, Stoughton, MA (US)

(73) Assignee: Ingersoll Rand Company, Piscataway, NJ (US)

( * ) Notice: Subject to any disclaimer, the term of this patent is extended or adjusted under 35 U.S.C. 154(b) by 84 days.

(21) Appl. No.: 12/426,646

(22) Filed: Apr. 20, 2009

(65) Prior Publication Data

US 2009/0282876 A1 Nov. 19, 2009

Related U.S. Application Data

(60) Provisional application No. 61/046,254, filed on Apr. 18, 2008, provisional application No. 61/098,961, filed on Sep. 22, 2008.

(51) Int. Cl.
*E05B 47/06* (2006.01)

(52) U.S. Cl. ..... 70/21; 70/38 A; 70/49; 70/208; 70/279.1; 70/283; 292/DIG. 37

(58) Field of Classification Search ..... 70/38 A, 70/279.1, 21, 30, 49, 38 B, 38 C, 208, 278.7, 70/278.1, 277, 282, 283, 284, 285; 292/DIG. 37
See application file for complete search history.

(56) References Cited

U.S. PATENT DOCUMENTS

| | | | | |
|---|---|---|---|---|
| 4,609,780 | A | 9/1986 | Clark | |
| 4,851,652 | A | 7/1989 | Imran | |
| 4,864,115 | A | 9/1989 | Imran et al. | |
| 4,901,545 | A | 2/1990 | Bacon et al. | |
| 5,148,691 | A * | 9/1992 | Wallden | 70/279.1 |
| 5,372,019 | A * | 12/1994 | Hsiao | 70/38 A |
| 5,561,996 | A | 10/1996 | Chang | |
| 5,791,172 | A | 8/1998 | Deighton et al. | |
| 6,047,575 | A * | 4/2000 | Larson et al. | 70/278.1 |
| 6,386,007 | B1 * | 5/2002 | Johnson et al. | 70/408 |
| 6,761,051 | B1 * | 7/2004 | Tsai | 70/38 B |
| 6,898,952 | B1 * | 5/2005 | Lin | 70/38 B |
| 7,040,125 | B2 * | 5/2006 | Ciezki et al. | 70/208 |
| 2005/0039502 | A1 * | 2/2005 | Avganim | 70/58 |
| 2005/0199019 | A1 * | 9/2005 | Marcelle et al. | 70/38 A |
| 2006/0238294 | A1 * | 10/2006 | Gokcebay et al. | 340/5.54 |
| 2006/0283216 | A1 * | 12/2006 | Marcelle et al. | 70/38 A |
| 2007/0126551 | A1 * | 6/2007 | Slevin | 340/5.53 |
| 2008/0256991 | A1 * | 10/2008 | Goldman | 70/57.1 |

FOREIGN PATENT DOCUMENTS

| | | |
|---|---|---|
| GB | 2 144 483 | 3/1985 |
| WO | WO 90/15910 | 12/1990 |
| WO | WO 93/03246 | 2/1993 |

* cited by examiner

*Primary Examiner* — Lloyd Gall
(74) *Attorney, Agent, or Firm* — RatnerPrestia

(57) ABSTRACT

A lock assembly including a body and at least one locking member. An actuator mechanism within the body is moveable between locked and unlocked positions. The actuator mechanism may be actuated by either a key lock cylinder or an electronic actuator. The lock assembly may also include a memory configured to store user identification information.

19 Claims, 15 Drawing Sheets

PORTABLE LOCK WITH ELECTRONIC LOCK ACTUATOR

BACKGROUND OF THE INVENTION

The present invention relates to a portable lock. More particularly, the present invention relates to a portable lock with a housing and a locking member, the locking member releasable from a locked position via at least an electronic actuator.

It is commonly known that when an individual is concerned about maintaining articles in a secure environment, people routinely use a variety of locking devices to secure receptacles wherein the material to be safeguarded is retained, such as, for example, safety deposit boxes and lockers. In such settings individuals utilize padlocks of either the key or combination variety on the latches of these containers so as to maintain the contents in a secure fashion. Standard padlocks widely available today consist of three basic types: 1) A standard key lock which operates on the basis of a tumbler system and is actuated by inserting a key into a cylinder at the base of the lock which contains pins or mechanical devices which release a locking bar mechanism when the key is turned. 2) A standard combination padlock which is is operated by rotating a numbered dial on the front of the lock body. Attached to the dial internally, is a series of disks which have stops and open gaps cut out such that they are aligned to all be in the same open position by rotation of the dial in both directions based upon a pre-programmed set of numbers derived from a factory which produces the lock. According to this type of lock, once the aforementioned spaces are aligned in the open position, the lock can be opened by pulling down on the lock body. 3) A standard combination padlock which is operated by turning a series of numbered tumblers to a pre-set combination which aligns gaps in a locking bar to an open position. Once this open position is achieved, the lock is free to disengage when the lock body is pulled away from the locking bar. These types of locks have been available for a considerable period of time. However, unless the user has the key or is able to remember the factory-provided combination, it is not possible to open these locks. Further, it is not possible to change the method by which these locks may be opened.

In response to the foregoing and other problems, various electronic locks and lock-boxes incorporating padlocks have been developed. One example of an electronic door lock is "Self-Contained Electromechanical Locking Device", U.S. Pat. No. 4,901,545 to Bacon, which teaches an electromechanical lock incorporated into a doorknob for use on an original installation of a door lockset, or for retrofitting onto an existing door lockset. The lock in Bacon is characterized by a doorknob having the usual key-cylinder and tumbler mechanism. Additionally, Bacon comprises a keypad mounted on the top of the doorknob and connected to a computer controller housed within the knob. In turn, the controller is operably connected to a motor also housed within the knob. The motor moves a locking pin, which resides within an aperture adjacent the tumbler mechanism, between a locked and unlocked position. (See Item 65, FIG. 6 and Col. 5, Line 62-Col 6, Line 18). When a correct key-code is entered, the locking pin moves out of engagement with the tumbler mechanism, thereby allowing a key or a turn-key to turn in the key-hole and thus open the lock. Unfortunately, the mechanical linkage of the motor to the tumbler mechanism requires a bulky housing, which is suitable for a door lockset but unsuitable for a padlock, and the small locking pin in Bacon is unsuitable for securing a shackle in a padlock. Further, the lock in Bacon essentially has a two-stage unlocking procedure; first, the key-code must be entered, and second, the key must be turned within the lockset. This two-stage procedure saves battery life by reducing power consumption, but is thus unsuitable for a lock with a one-stage unlocking procedure.

Another example of a lock is found in "Gearshift Lock", U.S. Pat. No. 5,561,996 to Chang, which teaches a large padlock that prevents a gearshift from moving out of the park position, thereby preventing theft of the vehicle. The lock in Chang incorporates a lock box having two parallel passages to receive each end of a U-shaped shackle. The shackle has a recess on each end for locking engagement with the box. The lock box incorporates a locking mechanism which engages the recesses when the shackle is inserted within the passages. The locking mechanism embodies a motor having a pinion gear on its output shaft. The top of the pinion gear engages an upper rack gear, while the bottom of the pinion gear engages a lower rack gear. Each rack gear is "L" shaped, having a bar mounted perpendicularly on their ends. The rack gears are biased away from each other by a pair of springs, which drive the bars into the recesses. A mechanical key is used to activate a switch to drive the motor in a reverse (unlocking direction) which compresses the springs and urges the rack gears together. The motor is powered by the vehicle battery. It will be apparent to those of skill in the art that the rack gears and springs must be of a sufficient size to resist attempts to break the lock and, accordingly, a relatively large motor and power supply is required to generate sufficient torque to compress the springs and move the rack gears.

When driven in the reverse direction, the upper and lower rack gears are driven inwards, thus disengaging the bars from the recesses, thereby releasing the shackle from the lock box. While the lock in Chang is suitable for a large gearshift lock having an external power source, it is unsuitable for a small padlock requiring a self-contained power supply. Further, the lock in Chang requires the use of a key, and cannot be operated by simply entering a combination or key-code.

"Electronic Access Card Having Key Pads and Coils and Combination Using the Same", U.S. Pat. No. 4,864,115 to Imran and Clark, teaches an electronic access card that can be used to operate real estate agent lock boxes which retain a door key. Such boxes are typically combined with a padlock for securing the box to a doorknob, and are used to give several real estate agents access to a single door key of a dwelling, by affixing the lock box to an outside door of the dwelling. The access card contains a power supply and a plurality of programming features to allow the card to open multiple lock boxes, and to record and limit access time to the lock boxes.

"Electronic Lock Box, Access Card, System and Method", U.S. Pat. No. 4,851,652 to Imran, teaches a type of real estate agent lock box for retaining a door key combined with a padlock for securing the box to a doorknob. Imran includes an external electronic key, which houses a power supply for operating both the lock box and the padlock. Electromagnetic solenoids are used to move leaf springs to open the lock box and the padlock. It will be apparent to those of skill in the art that springs of sufficient size must be used in order to keep the box secured.

"Improved Electronic Security System", WO 93/03246 to Babler, teaches an electronic lock box for storing a mechanical key combined with a padlock for affixing the box to a doorknob. The lock box has a nest on its exterior to receive an electronic key. The lock box further includes an interior computer, an internal locking mechanism for the lock box, and an internal locking mechanism for the padlock. The padlock locking mechanism within the lock box includes a solenoid having a pair of plungers which are spring biased in an outward position to engage the shackle, and can be retracted by an electromagnetic winding within the solenoid to release the shackle.

The external electronic key has a keypad, a computer and a power supply to power both the electronic key and the lock box. To use the electronic key, it is inserted into the nest at which point the computer in the keypad communicates with the keypad in the lock box to establish a combination. At this point the real estate agent can use the keypad to enter a combination to either open the lock box or the shackle. The power to engage and disengage the locking mechanism is provided by batteries located within the external electronic key. While Babler is well suited to the needs of real estate agents, the lock box in Babler is not suitable for use as a simple Us padlock as the power supply and electronic key are not self-contained within the lock box. Furthermore, the combination of the lock box is not programmable within a self-contained unit.

"Electronically Controlled Security Container for Retaining Door Key", U.S. Pat. No. 5,791,172 to Deighton, teaches another type of real-estate electronic lock box combined with a padlock. The padlock shackle has a notched arm which engages a fork member pivotally mounted on the container chassis. The fork member is urged by a spring in a direction for disengagement but is retained in engagement by a cam which engages a second tapered wheel connected to the motor gear train. When the motor is driven in a certain direction, the cam is driven along the wheel and finally off the end thereof, permitting the fork to be driven out of engagement with the shackle arm. It will be apparent that the padlock in Deighton is not intended to secure a door shut, but only to retain the lock box on a door handle and, accordingly, in order to adapt Deighton for use as a padlock, a sufficiently large spring biasing device would be necessary to adequately secure the shackle. This is disadvantageous, because a large spring would require a larger motor and self-contained power supply in order to operate the lock. Deighton also incorporates an infrared key and lock actuation system, which is disadvantageous as the key could be lost.

"Electronic Secure Entry System Apparatus and Method", U.S. Pat. No. 4,609,780 to Clark, teaches another type of real-estate electronic lock box combined with a padlock. A notched shackle having a spring-biased latching member normally engaging the notch can be retracted from the notch with an electromagnetic solenoid, thereby releasing the shackle. A keypad connected to an electronic control board engages the solenoid when the correct keycode is entered into the keypad. However, similar to other prior art, the latching member must be sufficiently sized to prevent the shackle from opening thereby necessitating a larger spring and solenoid, and thus requiring the lock box to be of sufficient size to house the entire mechanism and power supply.

"Electronic Lock", WO 90/15910 to Symons, teaches an electronic lock having a notched shackle engaged by a pair of rods spring-biased outwardly to engage the notches. An electromagnetic solenoid can be activated to retract the rods inwardly, thereby releasing the shackle. Symons has the same disadvantages as other prior art, namely that a spring of sufficient size must be used to ensure the rods securely engage the shackle, thereby necessitating a sufficiently large solenoid and power supply to overcome the force of the springs.

"Locking Devices", GB 2 144 483 A to Miller et al., teaches two embodiments of an electronic padlock, both of which incorporate a rod which is spring biased to engage a recess in the shackle. Miller incorporates a solenoid or winding to compress the spring and retract the rod from the recess in the shackle. Unfortunately, the use of a spring necessitates a sufficiently sized power supply and solenoid to overcome the force of the spring. Accordingly, the power supply in Miller is external to the padlock, and is incorporated into an external key-device. Further, due to the constraints of batteries, this padlock is not suitable to a key-less, self-contained padlock having a long battery life between battery changes. Finally, the use of solenoids necessitates a shorting bridge to prevent false actuation by a powerful external magnet.

Each of these documents are incorporated fully by reference herein.

SUMMARY OF THE INVENTION

In one aspect, the present invention provides a lock assembly comprising a lock body, a locking member moveable relative to the lock body, and a locking mechanism within the lock body and configured to selectively engage the locking member to prevent movement of the locking member relative to the lock body. An actuating mechanism is associated with locking mechanism and is moveable between an unlocked positioned wherein the locking mechanism is disengageable from the locking member and a locked position wherein the locking mechanism is maintained in engagement with the locking member. An electronic actuator is associated with the actuating mechanism and is configured to selectively move the actuating mechanism between the locked and unlocked positions. A key actuated cylinder is associated with the actuating mechanism and is configured to selectively move the actuating mechanism between the locked and unlocked positions independent of the electronic actuator.

In another aspect, the present invention provides a lock assembly comprising a lock body, a locking member moveable relative to the lock body, and a locking mechanism within the lock body and configured to selectively engage the locking member to prevent movement of the locking member relative to the lock body. An actuating mechanism is associated with locking mechanism and is moveable between an unlocked positioned wherein the locking mechanism is disengageable from the locking member and a locked position wherein the locking mechanism is maintained in engagement with the locking member. An electronic actuator is associated with the actuating mechanism and is configured to selectively move the actuating mechanism between the locked and unlocked positions. An electrical assembly is configured to receive an unlock signal and associated identification indicia along therewith.

DETAILED DESCRIPTION OF THE INVENTION

Figure 1:
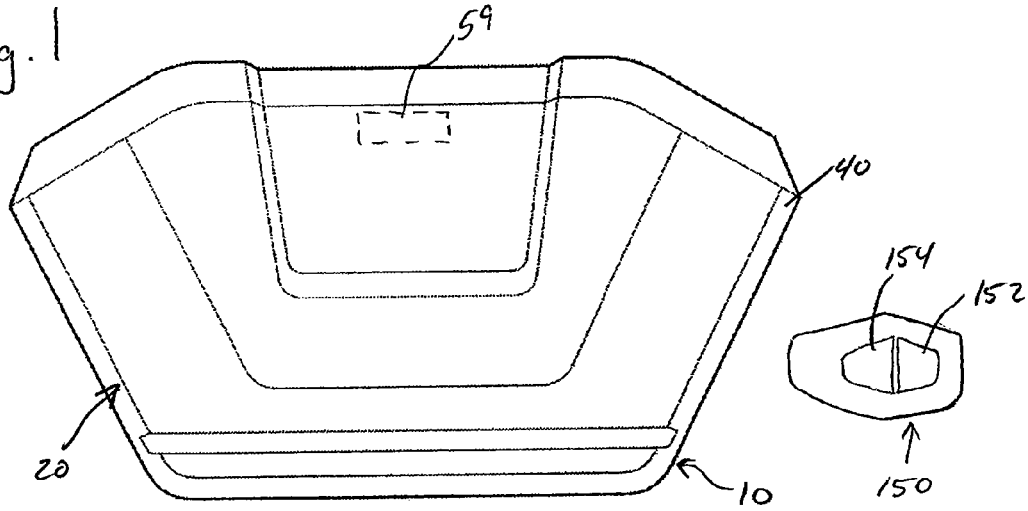
FIG. 1 is a front elevation view of a cable lock assembly in accordance with an embodiment of the present invention, with the cable removed for clarity.
Figure 2:
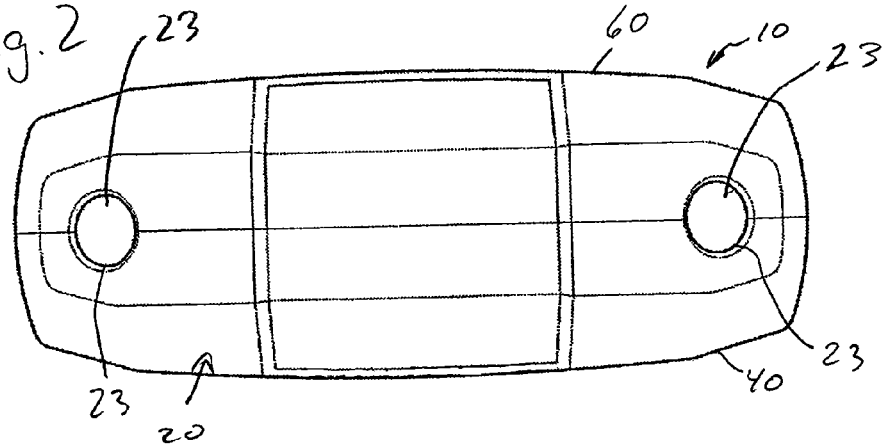
FIG. 2 is a top plan view of the cable lock assembly of FIG. 1.
Figure 3:
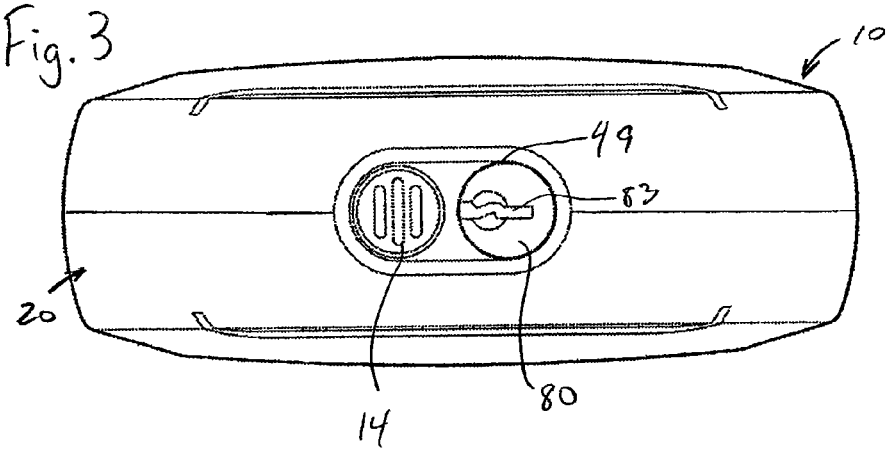
FIG. 3 is a bottom plan view of the cable lock assembly of FIG. 1.

The illustrated embodiments described herein show cable locks and padlocks, however, the invention is not limited to such. The locks of the present invention may have various body configurations and locking member configurations. For example, the lock may be a cable lock, a padlock, a U-lock, a steering wheel lock or any other lock configuration.

Referring to FIGS. 1-10, a lock assembly 10 that is a first embodiment of the present invention will be described. The lock assembly 10 is in the form of a cable lock, but the invention is not limited to such. The lock assembly 10 includes a lock body 20 which defines a pair of locking member openings 23. In the present embodiment, each opening 23 is configured to receive a locking leg 12 (see FIGS. 7-10) of a cable lock, but the legs 12 may be of other lock designs. The lock body 20 includes a through opening 49 in which is aligned the key slot 83 of a key lock cylinder 80 configured to receive a key (not shown) to unlock the lock assembly 10. As shown in phantom in FIG. 1, the lock assembly 10 also includes an electronic sensor 59, for example, an RF receiver, configured to receive an unlock signal from an electronic transmitter 150 which will then actuate an electronic drive as described in more detail below. The illustrated electronic transmitter 150 includes an unlock button 152 and a button 154 configured to operate a light on the transmitter 150, but such is not required. Additionally, a signal button 152 may not be required, but instead, the sensor 59 may be configured to sense when the transmitter 150 is within a given range. The unlock signal can be distinct for different users or groups of users such that the specific unlock signal received can be an indicator of the user or the group with which the user is associated. The lock assembly 10 would be configured to unlock based on the multiple unlock signals. The lock assembly 10 could thereafter by reprogrammed to discontinue access to one or more of the signals while still allowing other signals access.

Referring to FIGS. 4, 5 and 7-10, within the rear portion of the lock assembly 10 is a rear internal lock body 22. The rear internal lock body 22 includes a pair of opposed leg grooves 24 which align with the openings 23. Similar grooves 54 are provided on the front internal lock body 50. Adjacent to each leg groove 24 is a latch groove 26 configured to pivotally support a corresponding latch 72 which acts as a locking mechanism in the present embodiment. Each latch 72 includes a body 74 extending between a contact end 75 and a engagement end 77. Posts 76 extend from the body 74 and pivotally support the latch 72 in the respective groove 26. A biasing spring 73 extends between the groove 26 and the body 74 to bias the latch 72 toward a locked position (see FIGS. 7 and 8). In this locked position, the engagement end 77 engages a forward channel 13 on a respective leg 12, thereby locking the leg 12 within the lock body 20.

A pair of release plates 110 and 112 are supported in a transverse support groove 32 extending in the front and rear internal bodies 50 and 22. In the locked position, the contact ends 75 of the latches 72 contact the release plates 110 and 112 and, based on the springs 73, bias the plates 110 and 112 inward. An actuator mechanism 100 is positioned between the plates 110 and 112 and is configured to selectively urge the plates 110 and 112 outward, as described below, against the spring 73 bias to pivot the latches 72 about the posts 76 such that the engagement ends 77 disengage from the channels 13 (see FIGS. 9 and 10).

Referring to FIGS. 5, 7-10, the actuator mechanism 100 has a rotational body 102 with an engagement section 106 and a drive section 104 depending therefrom. The drive section 104 has a cross section configured to be received in and driven by either a key drive gear 86 or a key joining plate 84, as described below. The engagement section 106 has a double-D configuration, i.e. a narrow width w (see FIG. 7) in one orientation and a wider width W (see FIG. 9) in a second orientation. The second orientation is rotated 90° relative to the first orientation in the present embodiment, but the invention is not limited to such. In the locked position, the engagement portion 106 is in the first orientation such that the narrow width is between the plates 110 and 112. When the actuator mechanism 100 is rotated toward the second orientation, the wider width of the engagement portion 106 contacts the plates 110 and 112 and urges them outwardly to disengage the latches 72 as described above. The actuator mechanism 100 also includes a stop contact 108 the function of which is described below, which is moveable in a groove 34 within the body 20.

The actuator mechanism 100 may be driven by either the key lock cylinder 80 or an electronic actuator 90. The key lock cylinder 80 includes a drive plate 82 which is rotatable when a correctly cut key is inserted into the cylinder 80, as known in the art. The drive plate 82 contacts and thereby rotates a joining plate 84 which has a through hole 85 which matches the shape of the drive section 104. With the drive section 104 positioned in the through hole 85, rotation of the joining plate 84 via the drive plate 82 will cause rotation of the actuating mechanism 100.

A key drive gear 86 is positioned above the joining plate 84 and also includes a through hole 87 configured to receive the drive section 104. The key drive gear 86 is configured to engage an electronic drive gear 94 such that rotation of the electronic drive gear 94 will cause the key drive gear 86, and thereby the actuator mechanism 100, to rotate independent of the key cylinder 80. The electronic drive gear 94 has a through hole 95 configured to receive and be driven by the output shaft 92 of an electronic actuator 90. The electronic actuator 90 is powered by batteries or the like (not shown) in a power compartment 44 within the body 20. The electronic actuator 90 is configured to receive an unlock signal from the sensor 59 and will begin driving the shaft 92 when such is received. A stop sensor 120 (see FIG. 6) is provided to stop the electronic actuator 90 once the actuator mechanism 100 has been sufficiently rotated. The stop sensor 120 has a stop switch 122 which is aligned with the stop contact 108. In the locked position (FIGS. 7 and 8), the stop switch 122 is in a drive position such that the electronic actuator 90 is free to drive upon receiving an unlock signal. Once the actuator mechanism 100 has rotated to the unlocked position (FIGS. 9 and 10), the stop contact 108 engages the stop switch 122 which thereby sends a stop signal to the electronic actuator 90.

Figure 4:
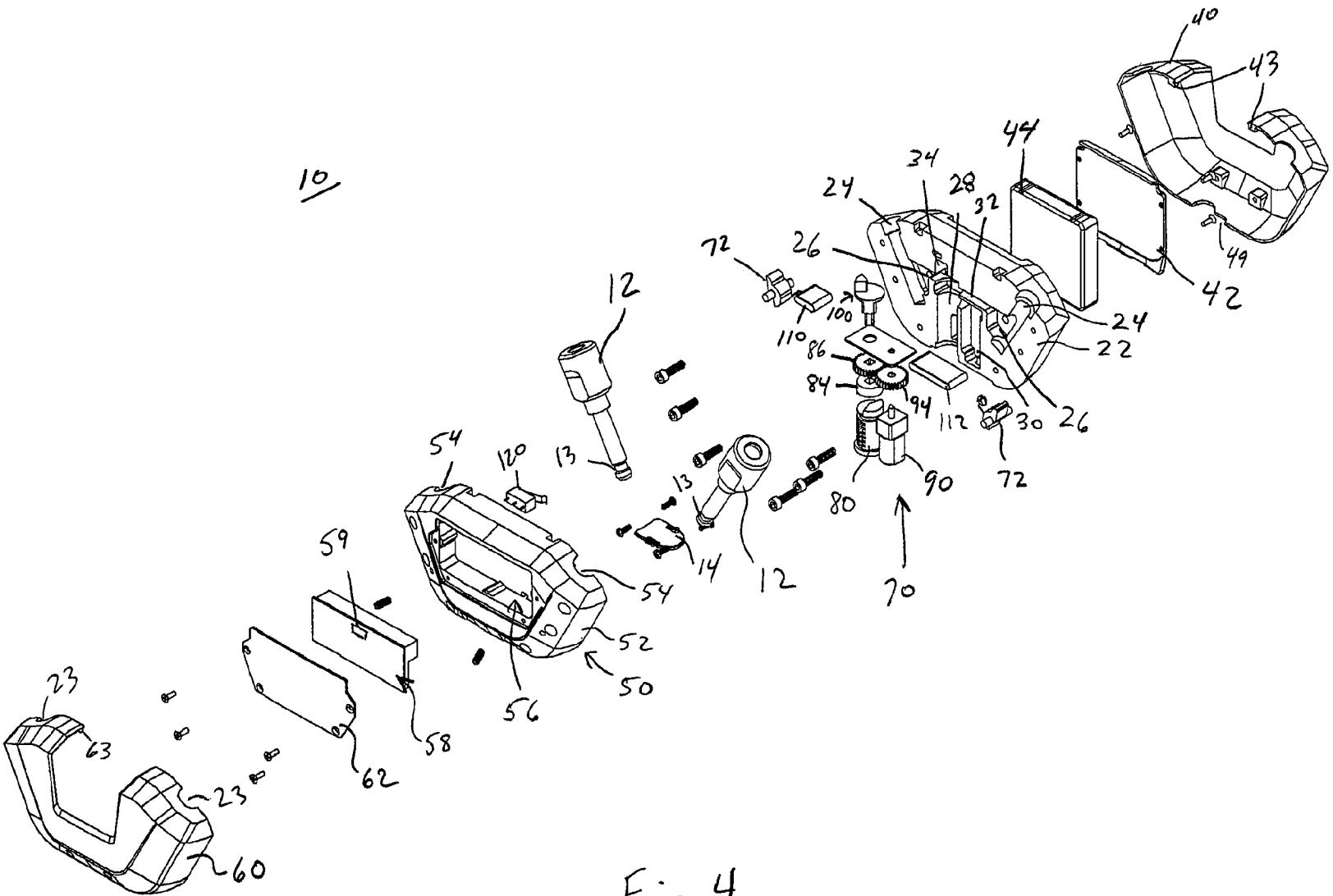
FIG. 4 is an exploded isometric view of the cable lock assembly of FIG. 1.
Figure 5:
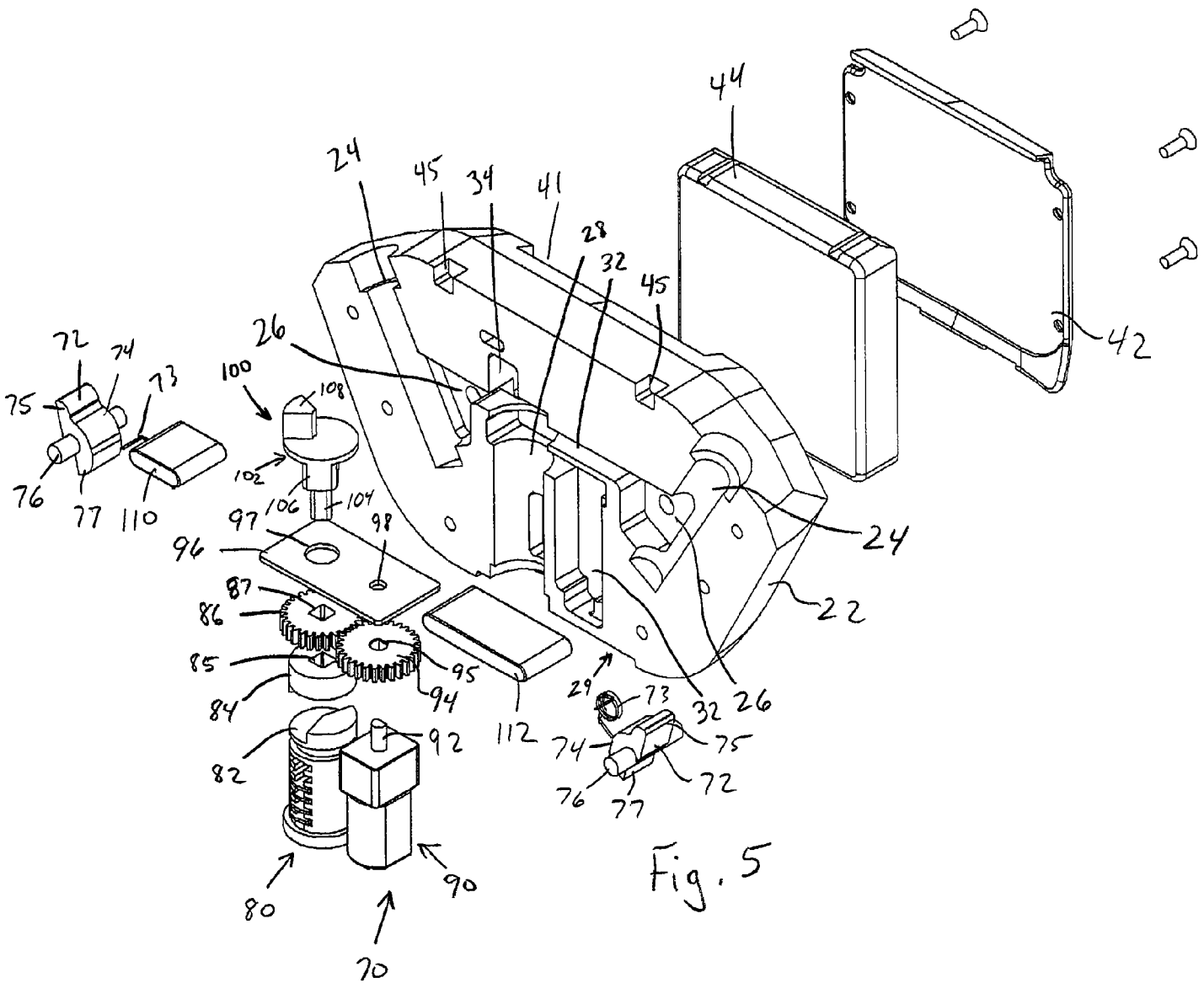
FIG. 5 is an exploded isometric view similar to FIG. 4 showing the rear portion of the lock assembly.
Figure 6:
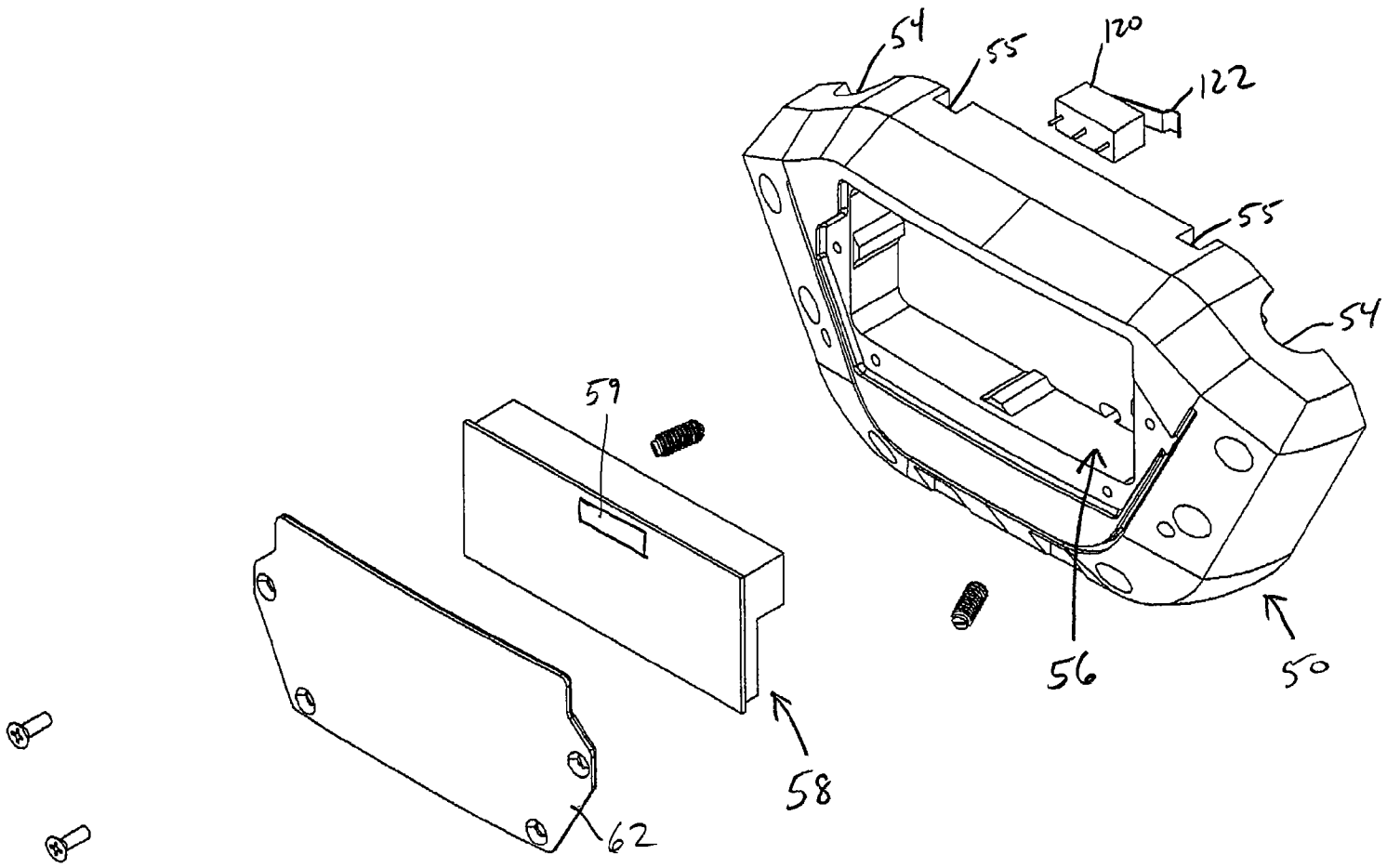
FIG. 6 is an exploded isometric view similar to FIG. 4 showing the front portion of the lock assembly.
Figure 7:
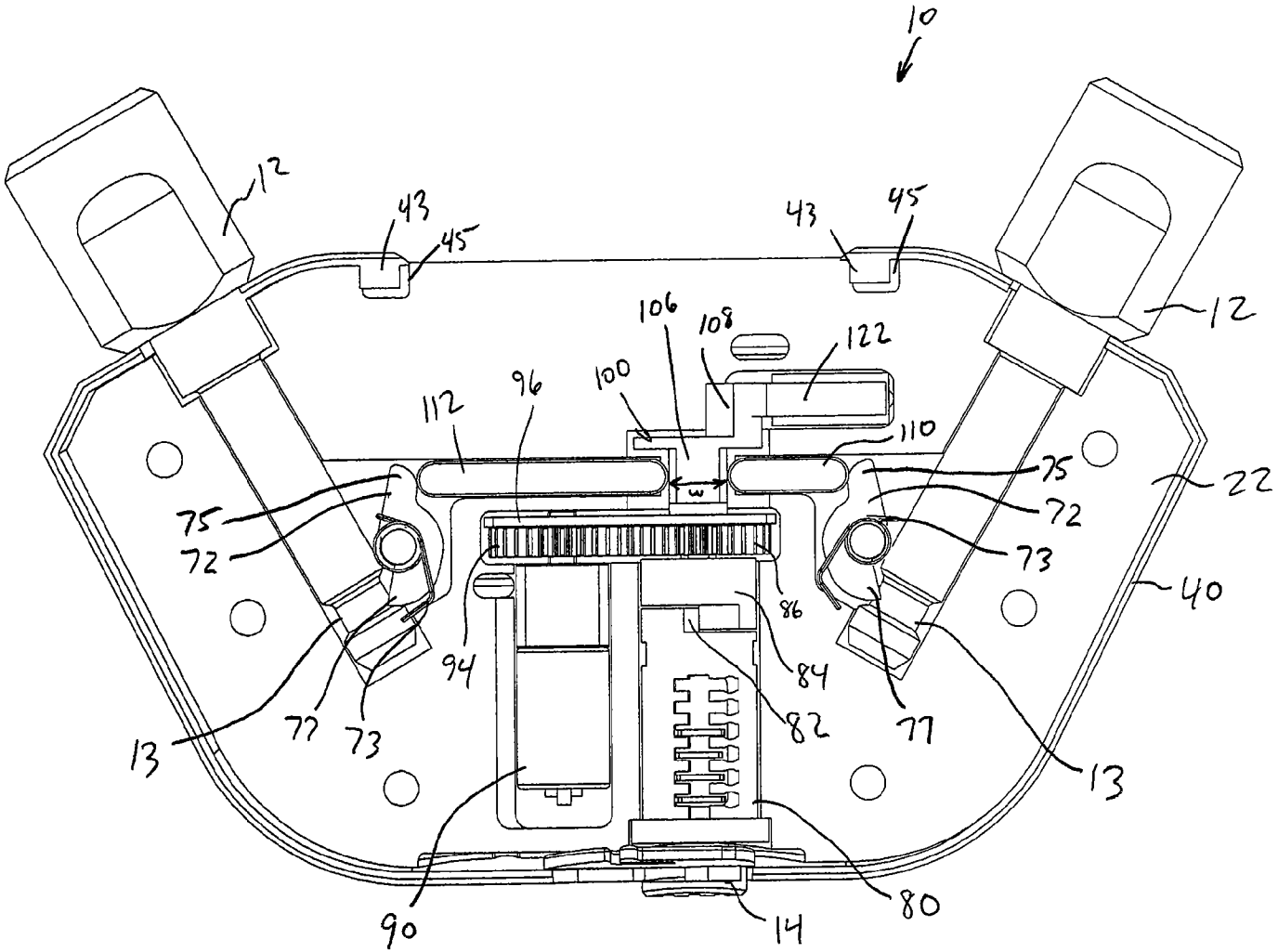
FIG. 7 is an assembled elevation view of the rear portion of the lock assembly of FIG. 1 in a locked condition.
Figure 8:
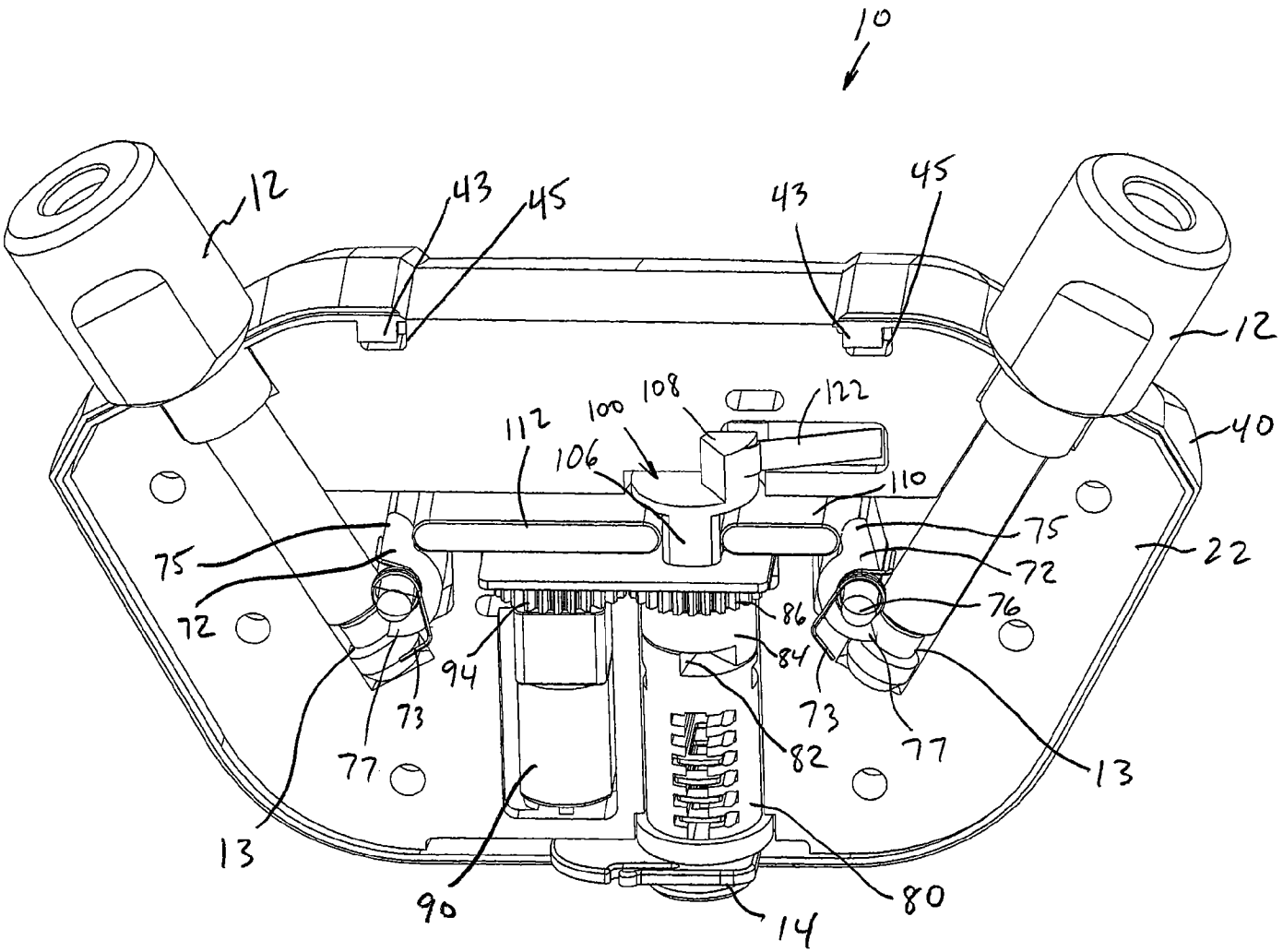
FIG. 8 is an assembled perspective view of the rear portion of the lock assembly of FIG. 1 in a locked condition.
Figure 9:
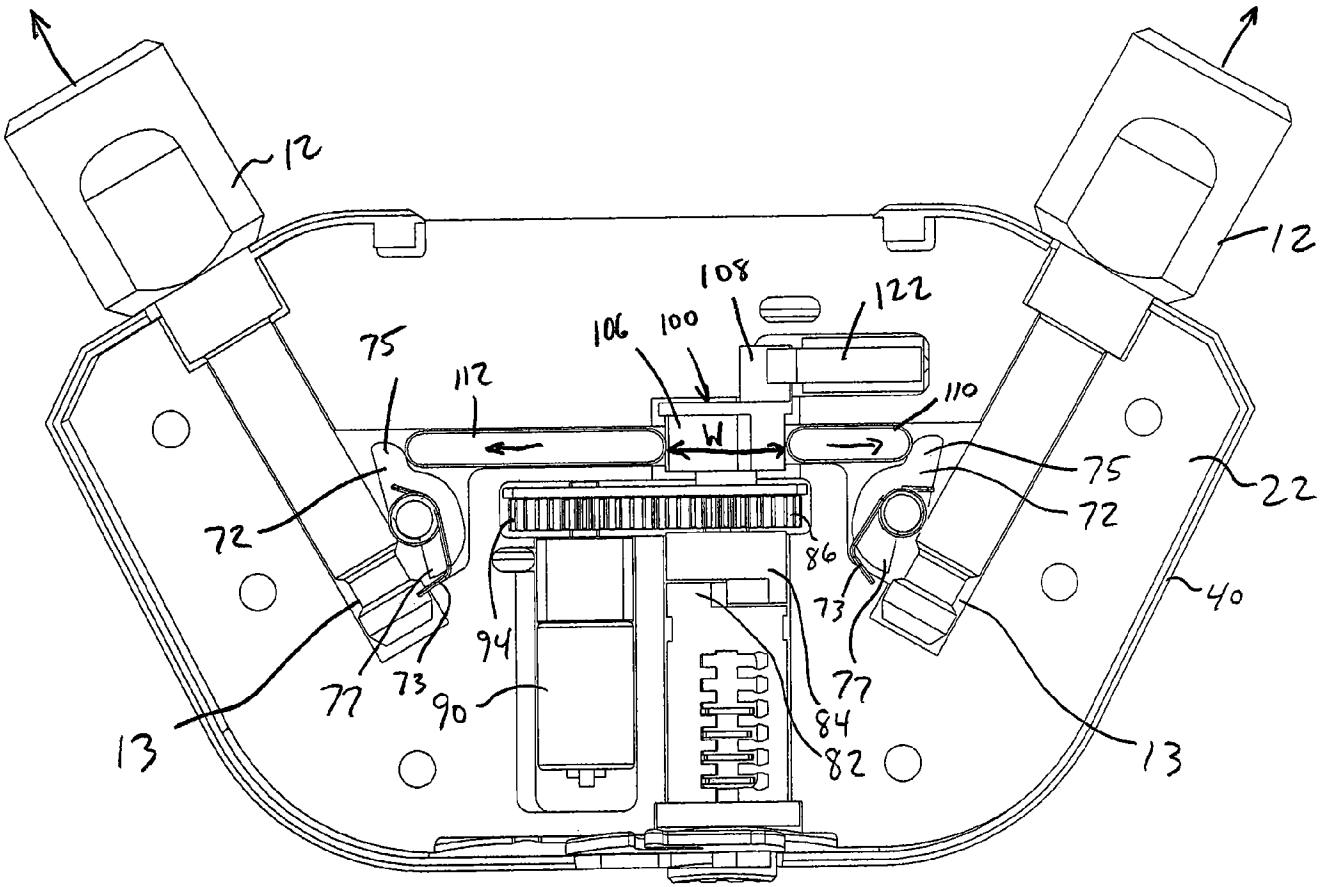
FIG. 9 is an assembled elevation view of the rear portion of the lock assembly of FIG. 1 in an unlocked condition.
Figure 10:
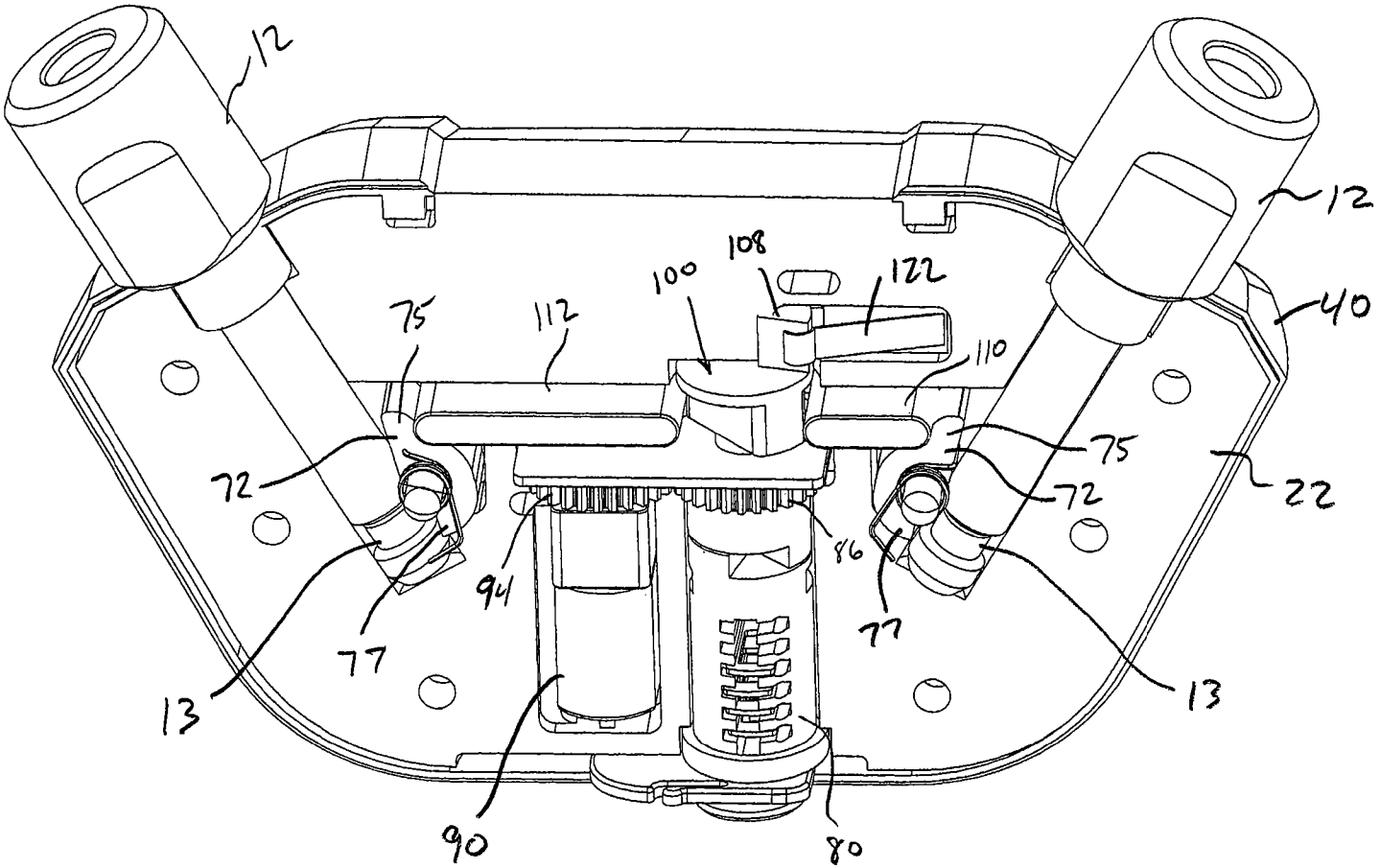
FIG. 10 is an assembled perspective view of the rear portion of the lock assembly of FIG. 1 in an unlocked condition.

Referring to FIGS. 4-6, the sensor 59 is supported by electronic control unit 58 which extends through an opening 56 in the front internal lock body 50. The stop sensor 120 is also supported in the front internal lock body 50. Securing plates 42 and 62 are preferably utilized to help secure the internal body components 22 and 50. Cover plates 40 and 60 enclose the internal body components 22 and 50. In the present embodiments the cover plates 40 and 60 includes tabs 43 and 63, respectively, configured to be received in notches 45 and 65, respectively, in the internal body components 22 and 50.

Figure 11:
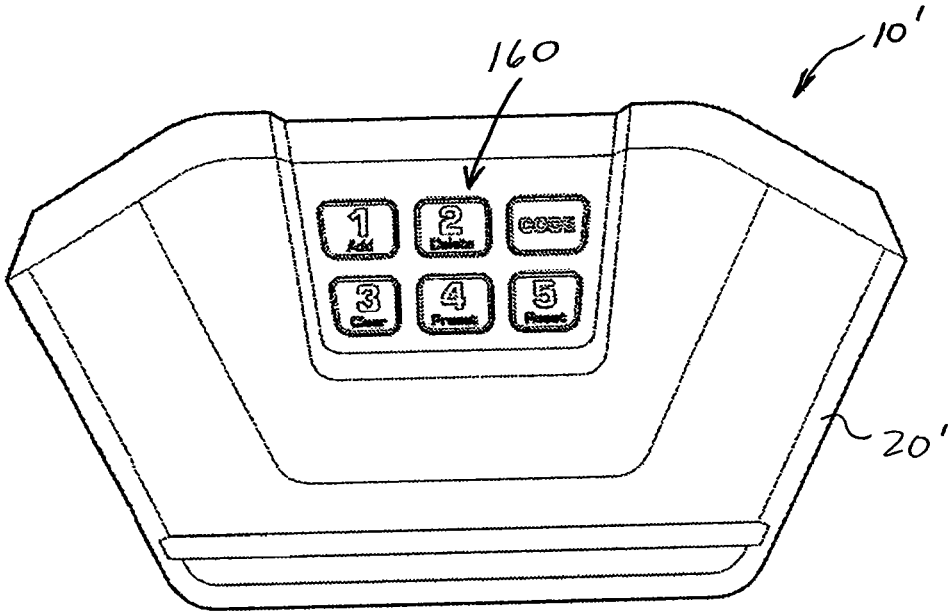
FIG. 11 is a front elevation view of a cable lock assembly in accordance with another embodiment of the present invention, with the cable removed for clarity.
Figure 12:
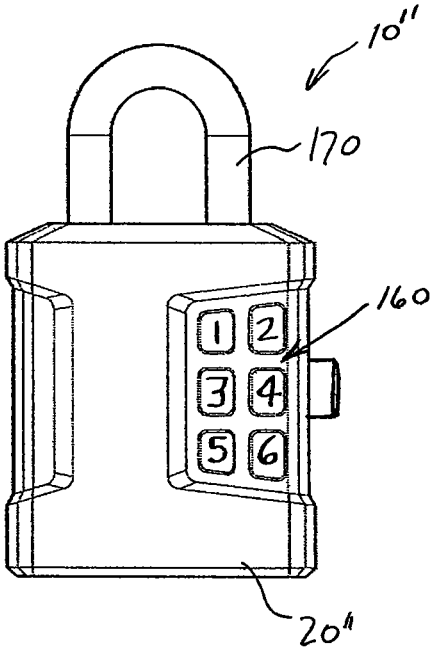
FIG. 12 is a front elevation view of a padlock assembly in accordance with another embodiment of the present invention.
Figure 13:
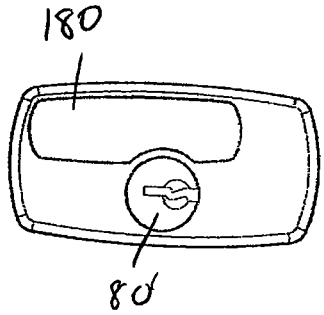
FIG. 13 is a bottom plan view of the padlock assembly of FIG. 12.
Figure 14:
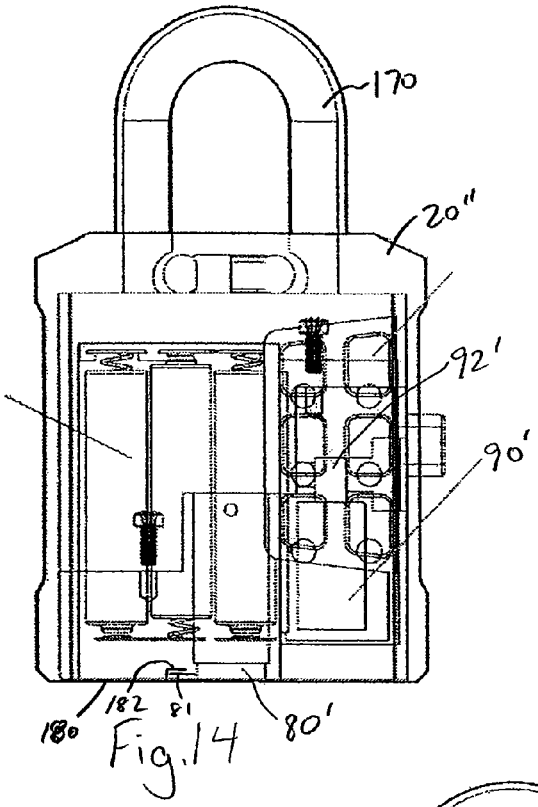
FIG. 14 is a front elevation view of the padlock assembly of FIG. 12, with the housing shown transparently, in a locked condition.
Figure 15:
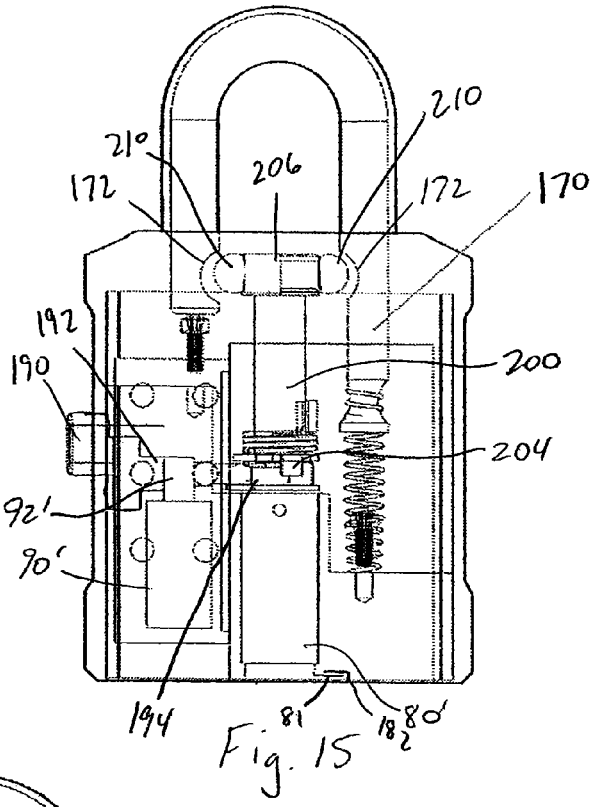
FIG. 15 is a rear elevation view of the padlock assembly of FIG. 12, with the housing shown transparently, in a locked condition.
Figure 16:
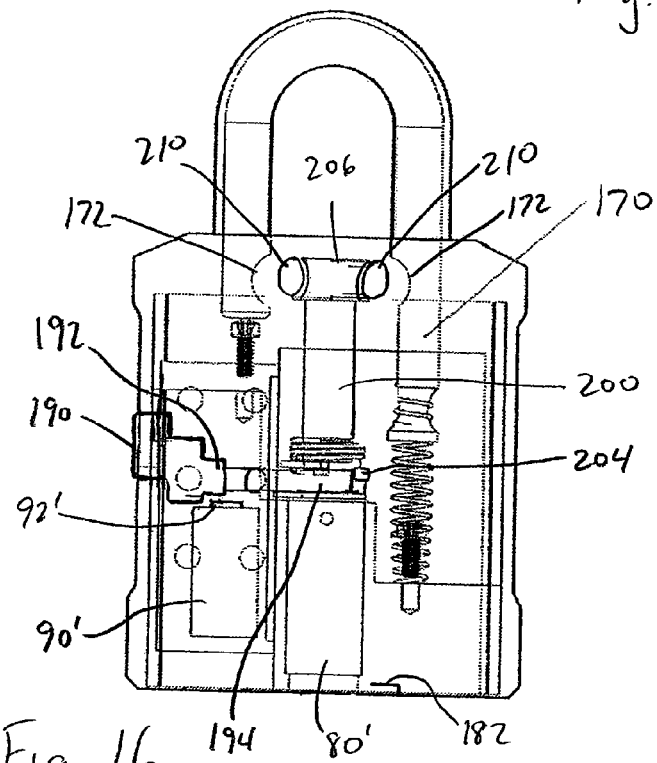
FIG. 16 is a rear elevation view of the padlock assembly of FIG. 12, with the housing shown transparently, in an unlocked condition.

Referring to FIG. 11, a lock assembly 10' that is an alternate embodiment of the invention is shown. The lock assembly 10' is essentially the same as the previous embodiment except that the body 20' includes an electronic keypad 160 which is configured to receive the input of an electronic unlock code. Upon receipt of the correct code, the electronic actuator 90 is actuated as described above. In all other respects, the lock assembly 10' is the same as in the previous embodiment. The input codes can be distinct for different users or groups of users such that the specific code entered can be an indicator of the user or the group with which the user is associated. The lock assembly 10' would be configured to unlock based on the multiple unlock codes. The lock assembly 10' could thereafter by reprogrammed to discontinue access to one or more of the codes while still allowing other codes access.

Referring to FIGS. 12-16, a lock assembly 10" that is another alternative embodiment of the invention will be described. The lock assembly 10" is similar to the previous embodiment in that it includes an electronic keypad 160 configured to provide an unlock signal. Alternatively, it could include a sensor as in the first embodiment. A battery cover 180 is shown on the outside of the lock body 20".

In the present embodiment, the key lock cylinder 80' is configured to rotate actuating mechanism 200 engaged therewith. The actuating mechanism 200 includes an engagement portion 206 again with two orientations, one providing a wider width in the locked condition (see FIG. 15) and a narrower width in the unlocked condition (see FIG. 16). In the locked condition, the engagement portion 206 urges locking balls 210, which act as the locking mechanism in the present embodiment, into engagement with notches 172 in the locking member or shackle 170 of the present embodiment.

In the present embodiment, the electronic actuator 90' does not directly drive the actuating mechanism 200. Instead, the electronic actuator 90' has an axial moving shaft 92' which is moveable between an extended position that engages the shoulder 192 of an unlock button 190 in the locked position (see FIG. 15) and a retracted position where the shoulder 192 is clear of the shaft 92' such that the unlock button 190 may be depressed. Upon depression of the unlock button 190, a forward end 194 thereof contacts a block 204 on the actuating mechanism 200 and thereby rotates the mechanism 200.

Referring to FIGS. 17-19B, a lock assembly 10'" that is another alternative embodiment of the invention will be described. The lock assembly 10'" is similar to the first embodiment in that it includes an electronic sensor 59' configured to receive an unlock signal, however, in the current embodiment, the sensor 59' is utilized with a padlock assembly. The sensor 59' is illustrated in phantom along an electronics assembly 180' positioned in the lower portion of the lock body 20'".

Figure 19A:
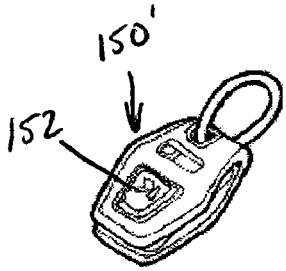
FIG. 19A is an isometric view of an alternative electronic transmitter.
Figure 19B:
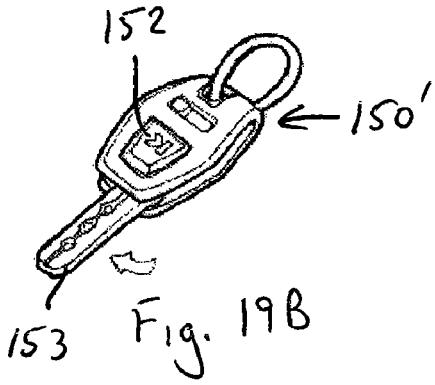
FIG. 19B is an isometric view of the electronic transmitter of FIG. 19A with the key shaft extended therefrom.

As described in the first embodiment, the sensor 59' is configured to receive an unlock signal from an electronic transmitter 150', for example as shown in FIGS. 19A and 19B. In this illustrated embodiment, the electronic transmitter 150' includes a signal button 152 whereupon depression thereof, an RF signal or the like is sent to the sensor 59' such that internal motor (not shown) rotates an actuating mechanism (not shown) in manner similar to that described in the above embodiment such that the shackle 170 may be disengaged from the locking balls (not shown) or the like. The locking balls or the like may be biased into engagement such that the lock body 20'" must be pulled to disengage the shackle 170 from the balls. While the illustrated electronic transmitter 150' includes a signal button, the transmitter may alternatively provide a continuous signal and the sensor 59' may be configured as a proximity sensor such that it senses when the transmitter 150' is within a certain distance. Upon sensing such, the lock assembly 10'" would be unlocked for a limited time during which the lock body 20'" could be pulled down from the shackle 170. The present embodiment of the lock assembly 10'" includes an indicator light 175, for example, an LED, which provides an indication when an unlock signal has been received.

Figure 17:
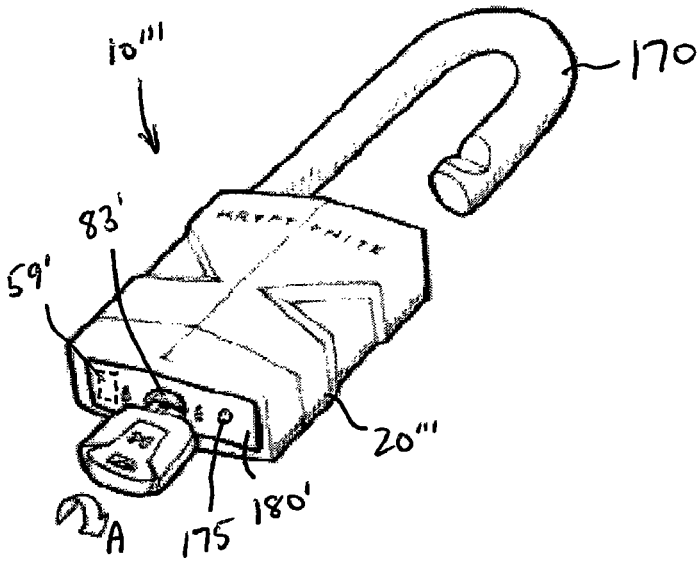
FIG. 17 is an isometric view of a padlock assembly in accordance with another embodiment of the present invention with the shackle in an unlocked position.
Figure 18:
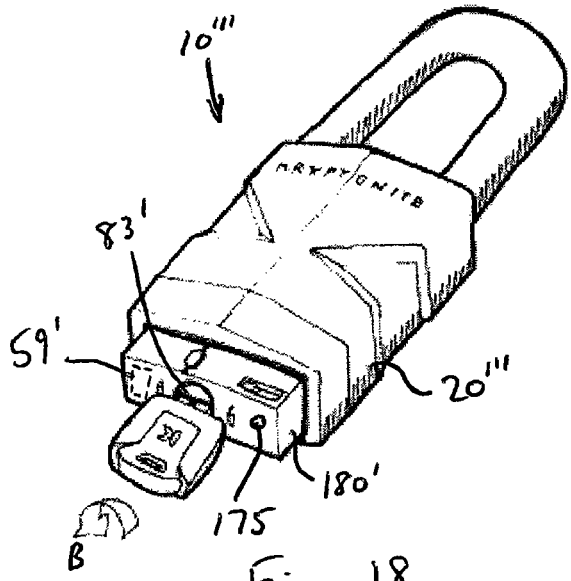
FIG. 18 is an isometric view of the padlock assembly of FIG. 17 with the key rotated in a program direction.

As shown in FIGS. 17 and 18, the lock assembly 10'" also includes a keyway 83' configured to receive a key shaft. The keyway 83' is configured to receive a correctly cut key shaft 153 which allows rotation in both directions. As illustrated in FIGS. 19A and 19B, the key shaft 153 may be stored in the electronic transmitter 150' and selectively released when needed to manually actuate the lock assembly 10'". As shown in FIG. 17, the key may be rotated a first direction as indicated by arrow A to unlock the shackle 170. As illustrated in FIG. 18, the key may be rotated in the opposite direction as indicated by arrow B to remove the electronics assembly 180' from the lock body 20'", for example, to replace the batteries. The electronics assembly 180' may also be configured such that rotation in such direction disengages the sensor 59' such that the lock assembly 10''' cannot be electronically controlled.

Figure 20:
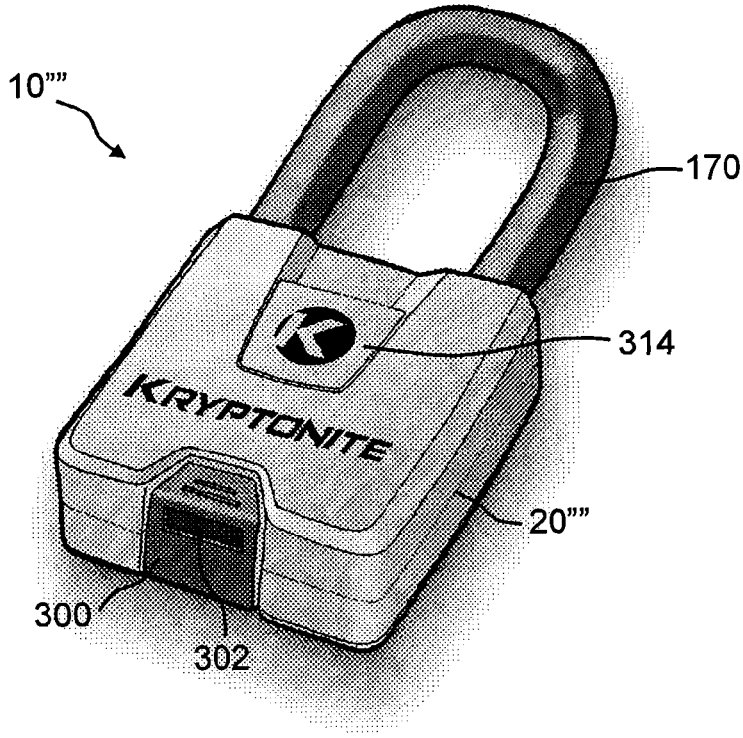
FIG. 20 is an isometric view of a padlock assembly in accordance with another embodiment of the present invention.
Figures 21A, 21B, 21C:
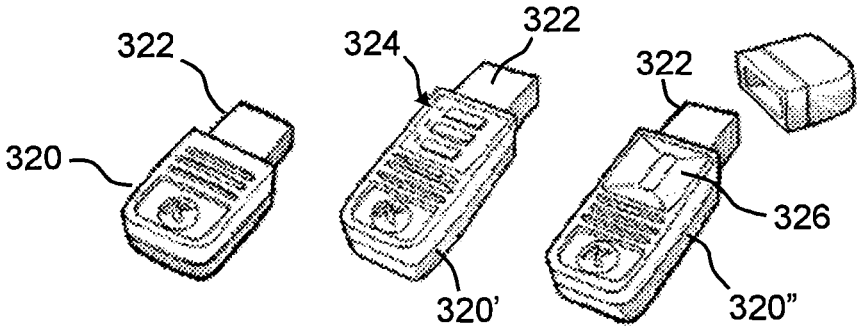
FIGS. 21A-21C are isometric views of illustrative electronic transmitters for use with the padlock assembly of FIG. 20.
Figure 22:
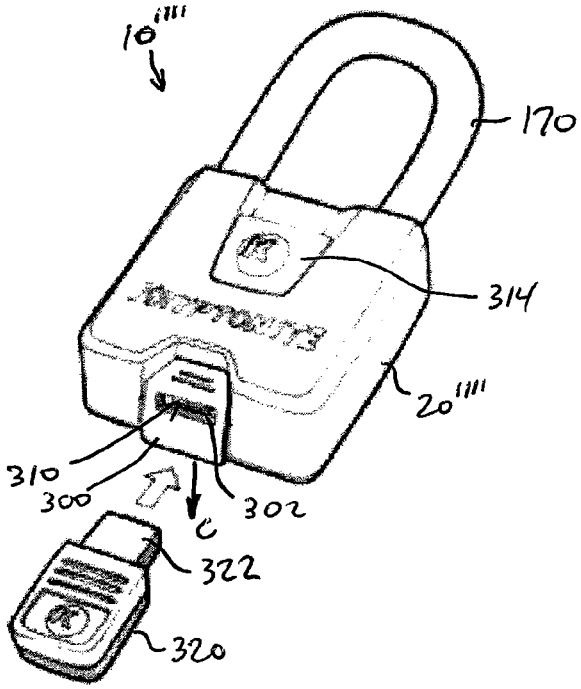
FIG. 22 is a view similar to FIG. 20 showing the transmitter cover in an open position.

Referring to FIGS. 20-23, a lock assembly 10'''' that is another alternative embodiment of the invention will be described. The lock assembly 10'''' is similar to the previous embodiment in that it provides an electronically controlled padlock assembly. However, rather than a sensor, the lock assembly 10'''' includes an electronic transmitter port 310 (see FIG. 22) extending into the lock body 20''''. FIG. 20 shows a transmitter cover 300 positioned over and covering the transmitter port 310. The transmitter cover 300 includes a through hole 302 that is alignable with the port 310 by sliding the transmitter cover 300 along the body 20'''' as indicated by arrow C in FIG. 22. While a downward motion is shown in FIG. 22, the transmitter cover 300 is not limited to such, but instead may move upward or alternatively side to side.

Figure 24:
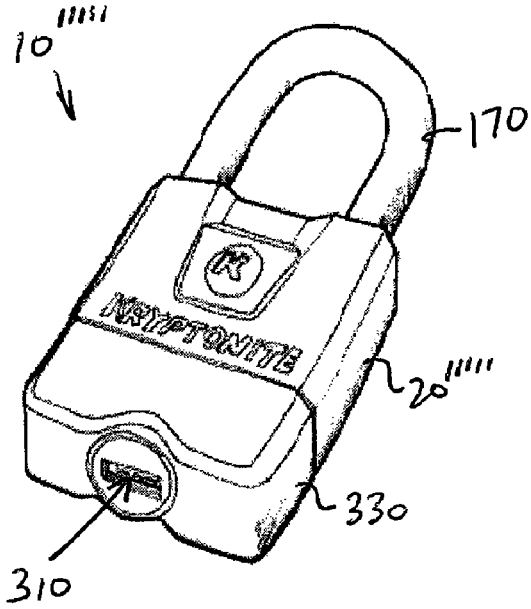
FIG. 24 is an isometric view of a padlock assembly in accordance with another embodiment of the present invention.
Figure 25:
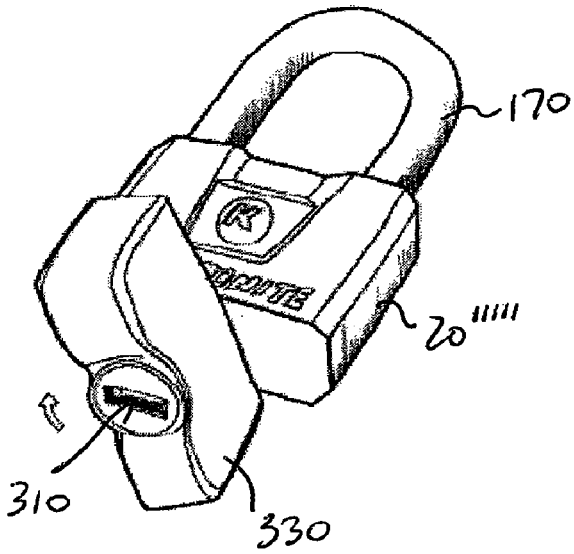
FIG. 25 is an isometric view of the padlock assembly of FIG. 24 with a body portion rotating to an unlock position.

The transmitter port 310 is configured to electronically receive a connection end 322 of an electronic transmitter 320 as shown in FIGS. 21A-22C. In the illustrated embodiments, the connection end 322 and the port 310 have corresponding USB configurations, but other configurations may be utilized. Upon connection of the connection end 322 of the electronic transmitter 320 with the port 310, the electronic assembly (not shown) within the lock body 20'''' determines if a correct unlock code is stored with the transmitter 320. Information may be stored on the transmitter 320 using a computer or the like. Upon detection of a correct unlock code, the internal motor (not shown) rotates the actuating mechanism (not shown) in a manner similar to that described in the above embodiment such that the shackle 170 may be disengaged from the locking balls (not shown) or the like. The locking balls or the like may be biased into engagement such that the lock body 20'''' must be pulled to disengage the shackle 170 from the balls. In the lock assembly 10'''' illustrated in FIGS. 24 and 25, the lock body 20'''' includes a secondary portion 330 which is rotatable to the lock body 20'''' to cause the shackle 170 to disengage and open.

The electronic transmitter 320 may have additional information stored thereon, for example, the user's identity, such that an access log or the like may be stored in the memory of the lock assembly 10'''''. Furthermore, as shown in FIGS. 21B and 21C, the electronic transmitter 320', 320" may include additional security features such that it can only be used by a designated individual. The electronic transmitter 320' illustrated in FIG. 21B includes a number pad 324 such that the user has to punch in an appropriate combination before the transmitter 320' can be utilized. The specific code can also be utilized to provide the identity of the user. Similarly, the electronic transmitter 320" illustrated in FIG. 21C includes a biometric reader 326 such that the user has to provide an authorized finger print or the like before the transmitter 320" can be utilized. Again, the specific biometric identifier can also be utilized to provide the identity of the user. Preferably the code or biometric identifier would enable the transmitter 320', 320" for a limited time such that the next time it is used, the code or identifier must be reentered.

Figure 23:
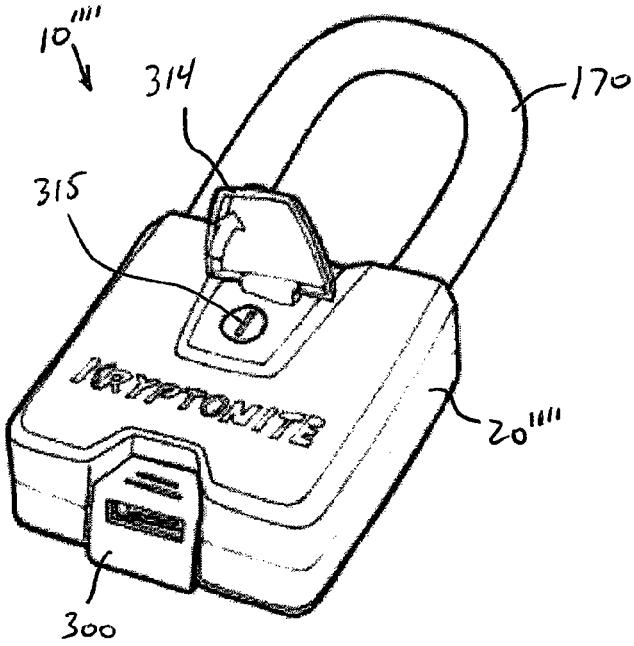
FIG. 23 is a view similar to FIG. 20 showing the master key cover in an open position.

As illustrated in FIG. 23, the lock assembly 10'''' also includes a keyway 315 under a keyway cover 314. The keyway 315 may be utilized to manually operate the lock.

Figure 26A:
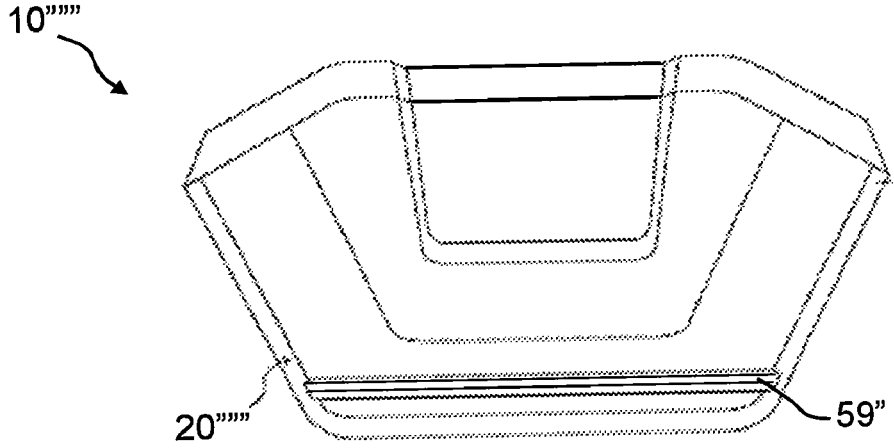
FIG. 26A is a front elevation view of another exemplary cable lock assembly, similar to the embodiment of FIG. 1, showing the sensor as a magnetic stripe reader.
Figure 26B:
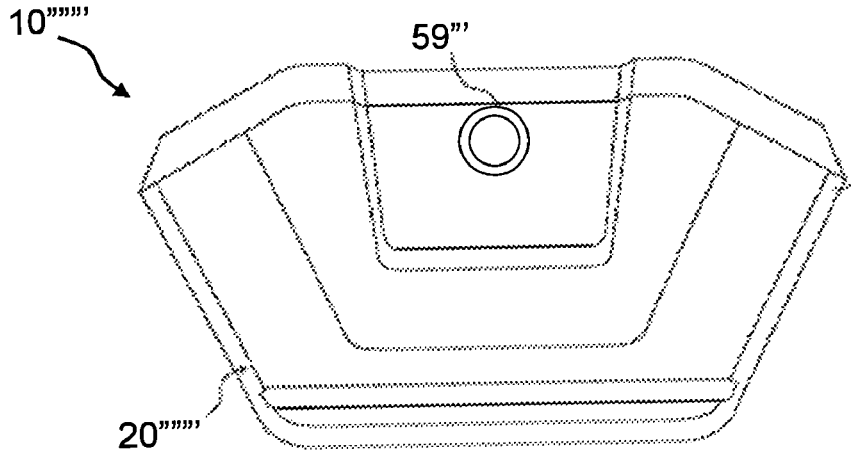
FIG. 26B is a front elevation view of another exemplary cable lock assembly, similar to the embodiment of FIG. 1, showing the sensor as an iButton reader.

While specific forms of transmitters and sensors have been illustrated and described herein, the invention is not limited to such. The electronic unlock signal may be provided using other signals and corresponding sensors, for example, but not limited to, biometric inputs and readers, magnetic stripe cards and associated readers 59" (see lock assembly 10''''' in FIG. 26A illustrating the magnetic stripe reader 59" along the lock body 20'''''), iButton devices and associated readers 59''' (see lock assembly 10''''' in FIG. 26B illustrating the I Button 59''' along the lock body 20''''') (available from Dallas Semiconductor). The iButton device is a mechanical packaging standard that places a 1-Wire component inside a small stainless steel button.

Additionally, while each of the embodiments is described with an electronic actuator and a key cylinder actuator, the invention is not limited to such, but may include the various electrical systems described herein without a key cylinder used in conjunction therewith. In embodiments utilizing just an electronic actuator, the lock assembly may include a backup charge port that allows at least temporary charging of the battery to unlock the lock in the event the batteries have died. For example, a temporary charge or more permanent charge may be provided through the transmitter port. Alternatively, a distinct charge input port may be provided in any of the embodiments of the lock assembly.

Furthermore, while specific configurations of lock bodies, locking members, locking mechanism and actuating assemblies are illustrated in the various embodiments, the invention is not limited to such and other configurations may be utilized.

Although the invention is illustrated and described herein with reference to specific embodiments, the invention is not intended to be limited to the details shown. Rather, various modifications may be made in the details within the scope and range of equivalents of the claims and without departing from the invention.

The invention claimed is:

1. A lock assembly comprising:

a lock body;

a locking member moveable relative to the lock body;

a locking mechanism within the lock body and configured to selectively engage the locking member to prevent movement of the locking member relative to the lock body;

an actuating mechanism associated with the locking mechanism, the actuating mechanism moveable between an unlocked position wherein the locking mechanism is disengageable from the locking member and a locked position wherein the locking mechanism is maintained in engagement with the locking member;

an unlock pushbutton that is moveably mounted to the lock body to selectively move the actuating mechanism between the locked and unlocked positions;

an electronic actuator that is moveable between a deployed position and a retracted position, wherein, upon depressing the unlock pushbutton while the electronic actuator is in the retracted position, the unlock pushbutton is configured to move the actuating mechanism between the locked and unlocked positions, and upon depressing the unlock pushbutton while the electronic actuator is in the deployed position, the unlock pushbutton is not configured to move the actuating mechanism between the locked and unlocked positions; and a key actuated cylinder associated with the actuating mechanism configured to selectively move the actuating mechanism between the locked and unlocked positions independent of the electronic actuator.

2. The lock assembly of claim 1 wherein the locking member includes a shackle.

3. The lock assembly of claim 1 wherein the locking member includes a cable.

4. The lock assembly of claim 1 wherein the electronic actuator is associated with an electronic input configured to receive an unlock signal.

5. The lock assembly of claim 4 wherein the electronic input is a sensor configured to receive an RF signal.

6. The lock assembly of claim 5 for use with an electronic transmitter wherein the electronic transmitter further includes a key configured to be received in the key actuated cylinder.

7. The lock assembly of claim 4 wherein the electronic input is a proximity sensor configured to receive a signal within a given distance of the lock assembly.

8. The lock assembly of claim 4 wherein the electronic input is a keypad.

9. The lock assembly of claim 4 wherein the electronic input includes a transmitter port in the lock body and an electronic transmitter has a connection end configured to be received in the transmitter port.

10. The lock assembly of claim 9 wherein the connection end and the transmitter port have a corresponding USB interconnection.

11. The lock assembly of claim 4 wherein the electronic input is a biometric reader.

12. The lock assembly of claim 4 wherein the electronic input is a magnetic reader configured to receive a signal from a magnetic strip card.

13. The lock assembly of claim 4 wherein the electronic input is a sensor configured to receive a signal from an iButton device.

14. The lock assembly of claim 4 wherein the electronic input is further configured to receive a user identifier.

15. A lock assembly comprising:

a lock body;

a locking member moveable relative to the lock body;

a locking mechanism within the lock body and configured to selectively engage the locking member to prevent movement of the locking member relative to the lock body;

an actuating mechanism associated with the locking mechanism, the actuating mechanism moveable between an unlocked position wherein the locking mechanism is disengageable from the locking member and a locked position wherein the locking mechanism is maintained in engagement with the locking member;

an unlock pushbutton that is moveably mounted to the lock body to selectively move the actuating mechanism between the locked and unlocked positions;

an electronic actuator that is moveable between a deployed position and a retracted position, wherein, upon depressing the unlock pushbutton while the electronic actuator is in the retracted position, the unlock pushbutton is configured to move the actuating mechanism between the locked and unlocked positions, and upon depressing the unlock pushbutton while the electronic actuator is in the deployed position, the unlock pushbutton is not configured to move the actuating mechanism between the locked and unlocked positions;

a key actuated cylinder associated with the actuating mechanism and configured to selectively move the actuating mechanism between the locked and unlocked positions independent of the electronic actuator; and an electronic assembly configured to control actuation of the electronic actuator based on receipt of an unlock signal, wherein the electronic assembly is further configured to receive and store identification information associated with a user.

16. The lock assembly of claim 15 wherein the electronic assembly is configured to receive and actuate the electronic actuator based on multiple unlock signals.

17. The lock assembly of claim 16 wherein each of the multiple unlock signals is associated with a given user or group of users and the received unlock signal provides the identification information.

18. A lock assembly comprising:

a lock body;

a locking member moveable relative to the lock body;

a locking mechanism within the lock body and configured to selectively engage the locking member to prevent movement of the locking member relative to the lock body;

an actuating mechanism associated with the locking mechanism, the actuating mechanism moveable between an unlocked position wherein the locking mechanism is disengageable from the locking member and a locked position wherein the locking mechanism is maintained in engagement with the locking member;

an unlock pushbutton that is moveably mounted to the lock body to selectively move the actuating mechanism between the locked and unlocked positions;

an electronic actuator that is moveable between a deployed position and a retracted position, wherein, upon depressing the unlock pushbutton while the electronic actuator is in the retracted position, the unlock pushbutton is configured to move the actuating mechanism between the locked and unlocked positions, and upon depressing the unlock pushbutton while the electronic actuator is in the deployed position, the unlock pushbutton is not configured to move the actuating mechanism between the locked and unlocked positions;

a key actuated cylinder associated with the actuating mechanism and configured to selectively move the actuating mechanism between the locked and unlocked positions independent of the electronic actuator; and a charger input associated with an internal power source of the electronic actuator and configured to connect to an external power source to provide at least a temporary charge to the power source.

19. The lock assembly of claim 18 wherein the charger input is also configured to receive an unlock control signal.

* * * * *

UNITED STATES PATENT AND TRADEMARK OFFICE

CERTIFICATE OF CORRECTION

PATENT NO. : 8,225,629 B2
APPLICATION NO. : 12/426646
DATED : July 24, 2012
INVENTOR(S) : Zuraski et al.

It is certified that error appears in the above-identified patent and that said Letters Patent is hereby corrected as shown below:

At Column 3, line 16, delete “Us”.

At Column 7, line 46, “65” should read -- 55 --.

At Column 8, line 31, “20”’” should read -- 20’” --.

At Column 10, line 2, “I Button” should read -- magnetic stripe reader --.

Signed and Sealed this
Twenty-fifth Day of September, 2012

David J. Kappos

David J. Kappos
*Director of the United States Patent and Trademark Office*